US006224978B1

(12) United States Patent
Chen et al.

(10) Patent No.: US 6,224,978 B1
(45) Date of Patent: May 1, 2001

(54) TONER FUSER ROLL FOR HIGH GLOSS IMAGING AND PROCESS FOR FORMING SAME

(75) Inventors: Jiann H. Chen, Fairport; Muhammed Aslam, Rochester; Gary F. Roberts, Macedon; Stephen V. Davis, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/879,896

(22) Filed: Jun. 20, 1997

(51) Int. Cl.[7] ..... D02G 3/00

(52) U.S. Cl. ..... 428/376; 428/378; 428/380; 428/391; 428/398; 428/401; 428/421; 428/447; 428/906; 264/645; 264/255

(58) Field of Search ..... 428/35.8, 36.8, 428/421, 447, 422, 372, 376, 378, 380, 391, 398, 401, 906; 264/645, 255

(56) References Cited

U.S. PATENT DOCUMENTS 4,430,406 * 2/1984 Newkirk et al. ..... 430/99
5,061,965 * 10/1991 Ferguson et al. ..... 355/284
5,292,606 3/1994 Fitzgerald .
5,336,539 8/1994 Fitzgerald .
5,464,698 11/1995 Chen et al. .
5,480,724 1/1996 Fitzgerald et al. .
5,582,917 12/1996 Chen et al. .
5,679,463 * 10/1997 Visser et al. ..... 428/447
5,716,714 * 2/1998 Chen et al. ..... 428/473.5

OTHER PUBLICATIONS

Technical Brochure, *Information about Silastic Silicone Elastomers*, Dow Corning Corporation, 1979.

* cited by examiner

*Primary Examiner*—William Krynski
*Assistant Examiner*—B. Shewareged
(74) *Attorney, Agent, or Firm*—Doreen M. Wells

(57) ABSTRACT

The toner fuser roll of the present invention, which is characterized by good thermal conductivity and resistance to degradation by release agents in addition to excellent wear properties, is capable of producing toner fused images with desirably high gloss. In accordance with the invention, the fuser roll comprises a cylindrical core and a base cushion layer comprising a condensation-cured poly (dimethylsiloxane) elastomer formed on the core. A barrier layer that comprises a cured fluorocarbon polymer and includes a particulate filler overlies the cushion layer. Overlying the barrier layer is a highly smooth outer surface layer comprising an addition-cured poly(dimethylsiloxane) elastomer and having a roughness value, $R_a$, no greater than about 10 microinches. Further in accordance with the invention is a process for forming the just described toner fuser roll. In addition to its capability of producing a highly smooth PDMS outermost layer, the process is environmentally advantageous, employing coating formulations containing volatile organic compounds at levels below those mandated by environmental regulations.

9 Claims, No Drawings

TONER FUSER ROLL FOR HIGH GLOSS IMAGING AND PROCESS FOR FORMING SAME

FIELD OF THE INVENTION

This invention relates in general to electrostatographic imaging and, in particular, to toner fuser rolls. More particularly, this invention relates to smooth-surfaced toner fuser rolls useful for producing multicolor images with improved gloss.

BACKGROUND OF THE INVENTION

In electrostatographic imaging and recording processes such as electrophotographic copying, an electrostatic latent image formed on a photoconductive surface is developed with a thermoplastic toner powder, which is thereafter fused to a receiver. The fusing member can be a roll, belt, or any surface having a suitable shape for fixing thermoplastic toner powder to the receiver. The fusing step commonly consists of passing the receiver, for example, a sheet of paper on which toner powder is distributed in an imagewise pattern, through the nip of a pair of rolls. At least one of the rolls is heated; in the case where the fuser member is a heated roll, a smooth resilient surface is bonded either directly or indirectly to the core of the roll. Where the fuser member is in the form of a belt, it is preferably a flexible endless belt having a smooth, hardened outer surface that passes around the heated roller.

A toner fuser roll includes a cylindrical core, often metallic, that typically has a heating source in its interior. A resilient base cushion layer, which may contain filler particles to improve mechanical strength and/or thermal conductivity, is formed on the surface of the core, which may advantageously be coated with a primer to improve adhesion of the resilient layer. Roll cushion layers are commonly made of silicone rubbers or silicone polymers such as, for example, poly(dimethylsiloxane) PDMS) polymers of low surface energy, which minimize adherence of toner to the roll.

Frequently, release oils composed of, for example, poly (dimethylsiloxanes) are also applied to the fuser roll surface to prevent the toner from adhering to the roll. Such release oils may interact with the PDMS in the resilient layer upon repeated use, which in time causes swelling, softening, and degradation of the roll. To prevent these deleterious effects caused by release oil, a thin banier layer of, for example, a cured polyfluorocarbon, is formed on the cushion layer.

Electrophotography can be used to create photographic quality multicolor toner images when the toner particles are small, that is, less than about 10 m, and the receivers, typically papers, are smooth. A typical method of making a multicolor toner image involves trichromatic color synthesis by subtractive color formation. In such synthesis, successive imagewise electrostatic images, each representing a different color, are formed on a photoconductive element, and each image is developed with a toner of a different color. Typically, the colors correspond to each of the three subtractive primary colors (cyan, magenta and yellow) and, optionally, black. The imagewise electrostatic images for each of the colors can be made successively on the photoconductive element by using filters to produce color separations corresponding to the colors in the image. Following development of the color separations, each developed separation image can be transferred from the photoconductive element successively in registration with the other color toner images to an intermediate transfer member. All the color toner images can then be transferred in one step from the intermediate transfer member to a receiver, where they are fixed or fused to produce a multicolor permanent image. To match the photographic quality produced using silver halide technology, it is desirable that these multicolor toner images have high gloss.

In the fusing of the toner image to the receiver, the area of contact of the fuser roll with the toner-bearing surface of the receiver sheet as it passes through the nip of the pair of rolls is determined by the amount pressure exerted by the pressure roll and by the characteristics of the resilient cushion layer. The extent of the contact area helps establish the length of time that any given portion of the toner image will be in contact with and heated by the fuser roll.

As previously mentioned, PDMS cushion layers may include fillers comprising inorganic particulate materials, for example, metals, metal oxides, metal hydroxides, metal salts, and mixtures thereof. For example, Fitzgerald U.S. Pat. No. 5,292,606, the disclosure of which is incorporated herein by reference, describes fuser roll base cushion layers that contain fillers comprising particulate zinc oxide and zinc oxide-aluminum oxide mixtures. Similarly, Fitzgerald U.S. Pat. No. 5,336,539, the disclosure of which is incorporated herein by reference, describes a fuser roll cushion layer containing dispersed nickel oxide particles. Also, the fuser roll described in Fitzgerald et al. U.S. Pat. No. 5,480,724, the disclosure of which is incorporated herein by reference, includes a base cushion layer containing 20 to 40 volume percent of dispersed tin oxide particles.

Filler particles may also be included in a barrier layer. For example, Chen et al. U.S. Pat. No. 5,464,698, the disclosure of which is incorporated herein by reference, describes a toner fuser member having a silicone rubber cushion layer and an overlying layer of a cured fluorocarbon polymer in which is dispersed a filler comprising a particulate mixture that includes tin oxide.

There remains a need for toner fuser rolls that resist degradation by release agents and have good thermal conductivity, and also produce fused images, including multicolor images, of high gloss. The toner fuser roll of the present invention, which is characterized by a highly smooth outermost layer with excellent wear properties, meets this need.

SUMMARY OF THE INVENTION

The toner fuser roll of the present invention, which is characterized by good thermal conductivity and resistance to degradation by release agents in addition to excellent wear properties, is capable of producing toner fused images with desirably high gloss. In accordance with the invention, the fuser roll comprises a cylindrical core and a base cushion layer comprising a condensation-cured poly (dimethylsiloxane) elastomer formed on the core. A barrier layer that comprises a cured fluorocarbon polymer and includes a particulate filler overlies the cushion layer. Overlying the barrier layer is a highly smooth outer surface layer comprising an addition-cured poly(dimethylsiloxane) elastomer and having a roughness value, $R_a$, not exceeding about 10 microinches.

Further in accordance with the invention is a process for forming the just described toner fuser roll. In addition to its capability of producing a highly smooth PDMS outermost layer, the process is environmentally advantageous, employing coating formulations containing volatile organic compounds at levels below those mandated by environmental regulations.

DETAILED DESCRIPTION OF THE INVENTION

In the toner fuser roll of the invention, the condensation-cured poly(dimethylsiloxane) (PDMS) elastomer contained in the base cushion layer can be formed by a condensation reaction of silanol-terminated PDMS polymer units with a multifunctional silane compound comprising a silicon atom bonded to at least three groups that are functional to react with the terminal silanol groups.

Silanol-terminated PDMS polymers and their methods of preparation are well known. They are commercially available from, for example, United Chemical Co. or Emerson Cuming and have the general structure

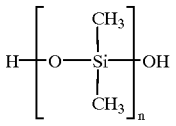

For the purpose of the present invention, n is an integer such that the silanol-terminated polymer unit has a weight-average molecular weight of about 7,000 to 80,000. If the molecular weight were below about 7,000, the final cured PDMS would have a high density that would render the material hard and brittle and insufficiently resilient to serve effectively as a cushion layer. If the molecular weight were above about 80,000, the final cured PDMS would undergo changes in hardness with time.

In the multifunctional silane compounds that serve as crosslinking agents for the PDMS units, the functional groups that react with the silanol end groups can be, for example, acyloxy (RCOO—), alkenyloxy ($CH_2$=C(R), alkoxy (RO—), dialkylamino ($R_2N$—), or alkyliminoxy ($R_2C$=N—O—), where R represents an alkyl moiety. Some specific examples of multifunctional crosslinking agents are methyltrimethoxysilane, tetraethoxysilane, methyltripropenoxysilane, methyltriacetoxysilane, methyltris(butanoneoxime)silane, and methyltnis (diethylammo)silane.

In a preferred embodiment of the invention, all the functional groups of the silane compound are alkoxy. Where alkoxy functional groups are employed, the condensation reaction can be carried out with the aid of a catalyst such as, for example, a titanate, chloride, oxide, or carboxylate of zinc, tin, iron, or lead. Some specific examples of suitable catalysts are zinc octoate, dibutyltin diacetate, ferric chloride, and lead dioxide.

The fuser roll base cushion layer, which preferably has a thickness of about 500$\mu$ to 5000$\mu$, can further comprise a particulate filler. This filler, which preferably comprises about 20 to 40 volume percent of the cushion layer, can be aluminum oxide,.iron oxide, calcium oxide, magnesium oxide, nickel oxide, tin oxide, zinc oxide, or mixtus thereof. In a preferred embodiment, the filler comprises zinc oxide particles.

The cured fluorocarbon polymer that comprises the barrier layer in the fuser roll of the present invention is preferably a random copolymer formed from mixtures of monomer units selected from vinylidene fluoride (VF), tetra-fluoroethylene (TFE), and hexafluoropropylene (HFP). Various suitable uncured fluorocarbon polymers are commercially available. For example, a material containing VF and HTP units in a molar ratio of 75:25 is sold by DuPont under the tradename Viton™ A. A similar copolymer, containing VF and HTP in a 42:58 molar ratio, is sold by Minnesota Mining and Manufacturing as Fluorel™ FX-2530. Suitable uncured fluorocarbon polymers preferably have number-average molecular weights in the range of about 75,000 to 200,000.

The barrier layer also includes a particulate filler that preferably about 20 to 40 volume percent of the layer. The filler can be aluminum oxide, iron oxide, calcium oxide, magnesium oxide, nickel oxide, tin oxide, and mixtures thereof. In a preferred embodiment, the filler is aluminum oxide, tin oxide, or mixtures thereof.

To form the barrier layer, a mixture of filler particles, uncured fluorocarbon polymer, and a crosslinking agent that may include an accelerator is applied over the base cushion layer and cured, as described in the aforementioned U.S. Pat. No. 5,464,698. The crosslinking agent is a basic nucleophile, preferably a bisphenol. Useful accelerators include, for example, organophosphonium salts. The resulting barrier layer has a thickness preferably of about 10$\mu$ to 50$\mu$.

The highly smooth outermost surface layer of the toner fuser roll of the present invention comprises an addition-cured poly(dimethylsiloxane) elastomer and silica and titania fillers. The surface layer, whose thickness is preferably about 10$\mu$ to 50$\mu$, has a roughness value, $R_a$, no greater than about 10 microinches, as determined by measurements on a 15-inch long roller using a Federal Surfanalyzer 4000 Profilometer provided with a transverse chisel stylus moving at a speed of 2.5 mm/sec.

A preferred commercially available material for forming the highly smooth outermost surface layer is Silastic™ E RTV silicone rubber, from Dow Corning Corporation. In that company's technical brochure, *Information about Silastic Silicone Elastomers*, Silastic™ E RTV is described as "a two-part system consisting of a base and curing agent," with a specified Base/Curing Agent Ratio of 10:1. In a description of the recommended mixing procedure, the brochure further directs that the "catalyst and base are mixed just before using in the amount of one part catalyst to 10 parts of Silastic™ E RTV silicone rubber (by weight)." Applicants have now discovered that mixing the silicone rubber and curing catalyst in a weight ratio of 5:1 unexpectedly results in a much smoother outermost surface layer than is obtained using the manufacturer-recommended ratio of 10:1. As previously discussed , a highly smooth surface layer is desirable for achieving fused multicolor images of excellent quality. Although the use of Silastic™ E silicone rubber for fuser roll outer layers is mentioned in the previously cited U.S. Pat. Nos. 5,292,606, 5,336,539, and 5,464,698, there is no description of the smoothness characteristics of the surface layers, nor is there any suggestion whatsoever to depart from the manufacturer's recommended mixing instructions for this material.

Applicants have utilized their discovery of beneficially modifying the outermost layer formulation to produce a surface of unexpectedly high smoothness in an environmentally advantageous process for forming a toner fuser roll. To comply with the National Ambient Air Quality Standards, the New York State Department of Environmental Conservation has issued regulations (Title 6, §228.7) that limit the amount of photochemically active volatile organic compounds (VOCs) to a total concentration not exceeding 3.5 pounds per gallon of coating formulation, excluding any water contained in the formulation. Most commonly employed organic solvents are included under these regulations, but acetone is an exempt compound. However its higher homologs, methyl ethyl ketone and methyl isobutyl ketone, are both regulated VOCs.

In the process of the invention, a base cushion layer comprising a condensation-cured poly(dimethylsiloxane) elastomer is formed, preferably by injection molding followed by curing, on a cylindrical metal core. The formulation for the base cushion layer comprises a plurality of silanol-terminated poly(dimethylsiloxane) units and a multifunctional silane compound comprising a silicon atom bonded to at least three groups that are functional to react with hydroxy end groups of the silanol-terminated units.

On the base cushion layer is applied a layer of a formulation comprising an uncured fluorocarbon polymer, a nucleophilic crosslinking agent, an accelerator, a particulate filler, and a volatile organic compound. This layer is dried and cured to form a barrier layer. Preferably, the uncured fluorocarbon polymer in the barrier layer formulation comprises vinylidene fluoride and hexafluoropropylene units, the nucleophilic crosslinking agent is a bisphenol, the accelerator is an organophosphonium salt, the particulate filler is aluminum oxide, tin oxide, or mixtures thereof, tin oxide being especially preferred, and the volatile organic compound is acetone.

On the barrier layer is applied a layer of a formulation comprising vinylsubstituted poly(dimethylsiloxane), filers, a curing catalyst, and a volatile organic compound that preferably is methyl ethyl ketone, methyl isobutyl ketone, or mixtures thereof. This layer is dried and cured to form a highly smooth outermost surface layer whose roughness value, $R_a$, is no greater than about 10 microinches. It is particularly preferred that the total concentration of volatile organic compound in the outermost layer formulation not exceed 3.5 pounds per gallon of formulation, excluding any water in the formulation.

The toner fuser roll formed by the process of the invention preferably has a base cushion layer having a thickness of about 500$\mu$, to 5000$\mu$, a barrier layer laving a thickness of about 10$\mu$ to 50$\mu$ and a highly smooth outermost layer having a thickness of about 10$\mu$ to 50$\mu$.

The following examples further illustrate the invention:

EXAMPLE 1

Preparation of Toner Fuser Rolls

A. An aluminum cylindrical core is primed with GE 4044 priming agent, available from General Electric Co., and air dried. On the primed core is applied by injection molding a layer containing a functionalized silane crosslinling agent, a tin catalyst, and EC 4952(from Emerson Cuming), which is characterized as a silanol-terminated polymethylsiloxane having about 85 mole percent of difunctional dimethylsiloxane repeating units, about 15 mole percent of trifunctional methylsiloxane repeating units, and a number-average molecular weight of about 21,000. The layer is heated at 110° C. for 3 hours, then ramped over 12 hours to a temperature of 232° C. Heating of the roll at 232° C. is continued for 12 hours. The cured base cushion layer is ground to a thickness of about 100 mils (2500$\mu$), then corona treated for 1 minute at 300 watts.

For the preparation of the barrier layer, a premilled blend of Viton™ A fluorocarbon polymer (DuPont), bisphenol crosslinking agent, organophosphonium salt accelerator, and 35 volume percent tin oxide is dispersed, with stirring, in acetone containing a small amount of PS 513, an amino-functionalized PDMS available from United Chemical Co. The procedure for forming the barrier layer is similar to that described in Chen et al. U.S. Pat. No. 5,582,917, the disclosure of which is incorporated herein by reference, but with acetone rather than methyl ethyl ketone being used as the dispersing fluid. The formulation, containing 25 weight percent solids in acetone (currently exempt from environmental regulations) is ring coated on the cured base cushion layer. The barrier layer coating is allowed to air dry, then ramped over a 24-hour period to 260° C., at which temperature it is maintained for an additional period of 24 hours. The thickness of the cured barrier layer is about 1 mil (25$\mu$).

For the outermost surface layer of the fuser roll, a dispersion is prepared from 100 parts by weight Silastic™ E RTV silicone rubber and a total of 100 parts of a dispersing liquid comprising 85 parts methyl ethyl ketone and 15 parts methyl isobutyl ketone, both environmentally regulated volatile organic liquids (VOCs). To this dispersion is added 10 parts curing catalyst, (a base:curing agent ratio of 10:1, per the manufacturer's instructions). The resulting formulation contains 52.4 total weight percent of the Silastic™ E components and 47.6 total weight percent VOCs and has a density of 7.84 lb/gal, which yields a calculated VOC content of 3.76 lb/gal of formulation, a value above the upper limit permitted by environmental regulations.

A surface layer is coated on the cured barrier layer and allowed to air dry, heated briefly at 110° C. to remove volatile materials, then ramped over 4 hours to 200° C., at which temperature it is maintained for 12 hours longer. The thickness of the cured outermost layer is about 1 mil (25$\mu$).

The resulting toner fuser roll, designated C-1, is subjected to surface roughness value, $R_a$, measurement, to be described in Example 2.

B. To a roll comprising a base cushion layer and a barrier layer on an aluminum cylindrical core, prepared as described in section A above, is applied a formulation containing 120 total parts by weight of Silastic™ E RTV silicone rubber, comprising 100 parts base and 20 parts curing catalyst (a 5:1 ratio), in a total of 90 parts by weight of volatile organic liquid comprising 76.5 parts methyl ketone and 13.5 parts methyl isobutyl ketone. The resulting formulation contains 57.1 total weight percent Silasticl™ E components and 42.9 total weight percent VOCs and has a density of 7.98 lb/gal, which yields a calculated VOC content of 3.43 lb/gal of formulation, a value that falls below the upper limit of 3.5 lb/gal permitted by environmental regulations. The applied outer layer is dried and cured as described in section A above. The thickness of the cured outermost layer is about 1 mil (25$\mu$).

The resulting fuser roll, designated I-1, is subjected to surface roughness value, $R_a$, measurement, to be described in Example 2.

EXAMPLE 2

Surface Roughness Value Measurements of Fuser Rolls

Fuser rolls C-1 and I-1, prepared as described in Example 1, are subjected to roughness value, $R_a$ measurements using a Federal Surfanalyzer 4000 Profilometer provided with a transverse chisel stylus moving at a speed of 2.5 mm/sec. Similar measurements are also made on four commercially available toner fuser rolls, designated E-1, K-1, R-1, and T-1. These commercial rolls are of similar construction, having an iron oxide filled PDMS-polydiphenylsiloxane cushion layer and, sequentially overlying the cushion layer, a filled cured fluorocarbon polymer layer, an iron oxide filled PDMS interlayer, and a clear outermost layer of silicone varnish. The results of the roughness value measurements are shown in TABLE 1 below.

TABLE 1

| Fuser roll | $R_a$ (microinches) |
|---|---|
| C-1 (control | 43 |
| I-1 (invention) | 7 |
| E-1 (control) | 8 |
| K-1 (control) | 6 |
| R-1 (control) | 4 |
| T-1 (control) | 16 |

As shown by the results in TABLE 1, fuser roll C-1, whose outermost surface layer formulation is prepared according to the manufacturers instructions, is characterized by a high roughness value. Fuser roll I-1 of the invention, on the other hand, whose outermost layer formulation includes a curing catalyst in a concentration substantially in excess of that directed by the manufacturer, has an unexpectedly low roughness value, corresponding to a highly smooth surface. Low roughness values also result from the measurements of commercial fuser rolls E-1, K-1, and R-1, but, as will be shown in Example 3, the wear characteristics of these rolls are substantially inferior to those of fuser roll I-1 of the present invention.

EXAMPLE 3

Wear Measurements of Fuser Roll Surfaces

Slabs are prepared using the outermost layer formulations for fuser rolls C-1 and I-1, as described in sections A and B, respectively, of Example 1. These slabs are designated samples C-2 and I-2, respectively. Samples of the layer composites of the commercial fuser rolls E-1, K-1, R-1, and T-1 are also removed from their cylindrical cores and designated samples F2, K-2, R-2, and T-2, respectively. Each of these samples is subjected to wear testing using a Norman Abrader Device (from Norman Tool Co.), modified as described in the previously mentioned U.S. Pat. No. 5,582,917. After 1600 cycles, the step, which is the height of the indentation in the surface of the sample, is measured using the Federal Surfanalyzer 4000 Profilometer apparatus to provide an indication of comparative wear of the samples under evaluation. The results are given in TABLE 2 below.

TABLE 2

| Sample | Wear after 1600 cycles (mils) |
|---|---|
| C-2 (control | 2.2 |
| I-2 (invention) | 1.3 |
| B-2 (control) | >7.0 |
| K-2 (control) | 4.5 |
| R-2 (control) | 5.3 |
| T-2 (control) | 2.5 |

As shown by the data in TABLE 2, outstanding resistance to abrasion is obtained with sample I-2, formed from the formulation employed for the highly smooth outermost surface layer of fuser roll I-1 of the present invention. Samples C-2 and T-2 also display good wear resistance, but as shown by the results in TABLE 2, the fuser rolls corresponding to both of these samples are characterized by high surface roughness values. Substantially inferior resistance to abrasion is displayed by samples F-2, K-2, and R-2, corresponding to fuser rolls E-1, K-1, and R-1, respectively, whose measured surface roughness are low. Thus, of the fuser rolls evaluated, only roll I-1 of the invention has an outermost surface layer that is both highly smooth, with an $R_a$ not exceeding 10 microinches, and highly resistant to abrasion The invention has been described in detail with particular reference to certain preferred embodiments thereof, but it will be understood that variations and modifications can be effected within the spirit and scope of the invention.

What is claimed is:

1. A process for producing a toner fuser roll comprising:

on a cylindrical metal core, applying a formulation comprising a plurality of silanol-terminated poly (dimethylsiloxane) units and a multifunctional silane compound comprising a silicon atom bonded to at least three groups that are functional to react with hydroxy end groups of said silanol-terminated poly (dimethylsiloxane) units, and a particulate filler, to form a layer, and curing said layer, thereby forming a base cushion layer comprising a condensation-cured poly(dimethylsiloxane) elastomer;

on said base cushion layer, applying a formulation comprising an uncured fluorocarbon polymer, a nucleophilic crosslinking agent, an accelerator, a particulate filler comprising tin oxide, aluminum oxide, or mixtures thereof and, as a first volatile organic compound, acetone, to form a layer, and drying and curing said layer, thereby forming a barrier layer comprising a cured fluorocarbon polymer and a particulate filler; and on said barrier layer, applying a layer of a formulation comprising a plurality of vinylsubstituted poly (dimethylsiloxane) units, silica and titania fillers, a curing catalyst, and a second volatile organic compound in amounts effective to form a highly smooth outermost surface layer, wherein the second volatile organic compound is selected from the group consisting of methyl ethyl ketone, methyl isobutyl ketone, acetone, and mixtures thereof, and drying and curing said layer, wherein the weight ratio of silcone polymer resulting from polymerization of the vinylsubstituted poly(dimethylsiloxane) units to the curing catalyst is substantially less than 10:1 such that said surface layer has a roughness value not exceeding about 10 microinches.

2. The process of claim 1 wherein said base cushion layer further comprises a particulate filler selected from the group consisting of aluminum oxide, nickel oxide, tin oxide, zinc oxide, and mixtures thereof.

3. The process of claim 1 wherein said base cushion layer is formed by injection molding followed by curing.

4. The process of claim 1 wherein said base cushion layer has a thickness of about 500 $\mu$m to 5000 $\mu$m.

5. The process of claim 2 wherein the formulation for forming said base cushion layer comprises a plurality of silanol-terminated poly(dimethylsiloxane) units having a weight-average molecular weight of about 7,000 to 80,000, a compound comprising a silicon atom bonded to at least three alkoxy groups, and a particulate filler comprising zinc oxide, said filler comprising about 20 to 40 volume percent of said barrier layer.

6. The process of claim 1 wherein the formulation for forming said barrier layer comprises an uncured fluorocarbon polymer comprising vinylidene fluoride and hexafluoropropylene monomeric units, a crosslinking agent comprising a bisphenol, an accelerator comprising an organophosphonium salt, and a particulate filler selected from the group consisting of aluminum oxide, tin oxide, and mixtures thereof.

7. The process of claim 6 wherein said particulate filler is tin oxide and said volatile organic compound is acetone.

8. The process of claim 1 wherein said barrier layer has a thickness of about 10 $\mu$m to 50 $\mu$m.

9. The process of claim 1 wherein said outermost surface layer has a thickness of about 10 $\mu$m to 50 $\mu$m.

* * * * *